US008182894B2

(12) United States Patent
Bier et al.

(10) Patent No.: US 8,182,894 B2
(45) Date of Patent: May 22, 2012

(54) IDENTIFICATION PLATES

(75) Inventors: Klaus-Dieter Bier, Leutenbach (DE); Thomas Gangl, Mainhardt (DE)

(73) Assignee: Murrplastik Systemtechnik GmbH, Oppenweiler (DE)

( * ) Notice: Subject to any disclaimer, the term of this patent is extended or adjusted under 35 U.S.C. 154(b) by 312 days.

(21) Appl. No.: 12/450,815

(22) PCT Filed: Apr. 23, 2008

(86) PCT No.: PCT/EP2008/054907

§ 371 (c)(1),
(2), (4) Date: Oct. 14, 2009

(87) PCT Pub. No.: WO2008/141885

PCT Pub. Date: Nov. 27, 2008

(65) Prior Publication Data

US 2010/0112271 A1 May 6, 2010

(30) Foreign Application Priority Data

May 18, 2007 (DE) ..... 10 2007 023 532

(51) Int. Cl.
*G09F 3/02* (2006.01)

(52) U.S. Cl. ..... 428/76; 428/900; 40/316

(58) Field of Classification Search ..... 428/76, 428/900; 40/316; 174/112
See application file for complete search history.

(56) References Cited

U.S. PATENT DOCUMENTS

| | | | |
|---|---|---|---|
| 4,101,698 | A | 7/1978 | Dunning et al. |
| 4,215,170 | A | 7/1980 | Vilaprinyo |

FOREIGN PATENT DOCUMENTS

| | | |
|---|---|---|
| AT | 372 114 | 9/1983 |
| DE | 19 13 585 | 11/1969 |
| DE | 17 29 168 | 6/1971 |
| DE | 26 26 740 | 2/1977 |
| DE | 34 43 170 | 5/1986 |
| DE | 37 25 217 | 2/1989 |
| DE | 87 17 747 | 1/1990 |
| DE | 42 39 434 | 5/1994 |
| DE | 44 04 590 | 8/1995 |
| DE | 10 2005 058 387 | 6/2007 |
| EP | 1 385 186 | 1/2004 |
| GB | 1 242 165 | 8/1971 |
| WO | WO 91/03058 | 3/1991 |

OTHER PUBLICATIONS

International Search Report, Feb. 2008.
German Search Report dated Oct. 1, 2007 with English translations of relevant parts.

*Primary Examiner* — Alexander Thomas
(74) *Attorney, Agent, or Firm* — Collard & Roe, P.C.

(57) ABSTRACT

The invention relates to an identification tag (16) for identifying preferably electrical components, comprising a front side that has a marking area (18). According to the invention, the identification tag (16) has a plastic base (22) and a metal coating (24) that covers the surface of the base (22).

6 Claims, 1 Drawing Sheet

IDENTIFICATION PLATES

CROSS REFERENCE TO RELATED APPLICATIONS

Figure 2:
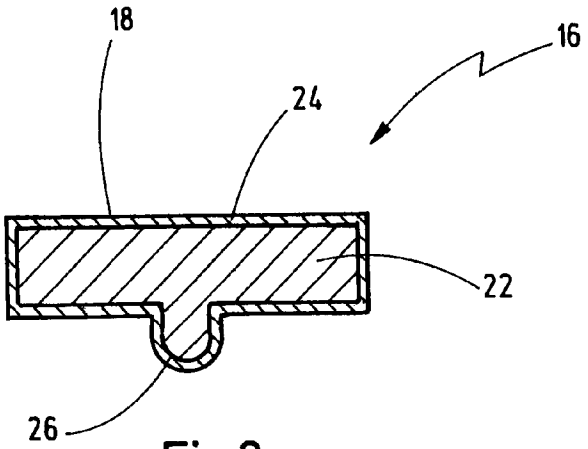

This application is the National Stage of PCT/EP2008/054907 filed on Apr. 23, 2008, which claims priority under 35 U.S.C. §119 of German Application No. 10 2007 023 532.3 filed on May 18, 2007. The international application under PCT article 21(2) was not published in English.

The invention relates to an identification plate as well as to a set of identification plates, and to a method for the production of identification plates.

Such identification plates serve to identify electrical components such as terminals, plugs, cables, leads, and the like. An identification that characterizes the component, in each instance, is imprinted onto the inscription surface or engraved into it. In this connection, the identification plates are produced from plastic, using an injection-molding or extrusion method, so that a plurality of identification plates connected with one another in one piece can be inscribed together in an inscription device. Such identification plate sets are described, for example, in DE-37 25 217 C2 and DE-10 2005 058 387. This type of identification plate sets has proven itself excellently in practice. However, identification plates made of plastic do not withstand higher temperatures for long. In particular, if they are exposed to temperatures above 100° C., their surface is quickly attacked.

For this reason, identification plates made of metal were developed for use at higher ambient temperatures. While these withstand higher temperatures, they demonstrate a number of other disadvantages. For example, they are not as elastic as the identification plates made of plastic, and this is particularly disadvantageous if they are attached to the component to be identified by means of engagement elements formed onto the back. Furthermore, it is difficult to produce sets of identification plates made of metal, so that the metal plates generally are cut from a strip. For inscription, they then have to be individually placed into an inscription device.

It is therefore the task of the invention to further develop an identification plate of the type stated initially, in such a manner that it can be used even at higher temperatures, while allowing sufficiently simple handling.

This task is accomplished by means of an identification plate according to the invention. Advantageous further developments of the invention are discussed below.

The invention is based on the idea that the plastic surface of the base body, which is sensitive to higher temperatures, is protected by the metallic coating. As a result, the heat resistance of the identification plate is increased, while at the same time, it demonstrates sufficient elasticity because of its base body made of plastic. If the plastic clearly differs in color from the color of the coating, a color contrast can be achieved by means of an engraving device, as the result of partial removal of the coating, thereby allowing good recognition of the identification marking. Furthermore, the identification plates according to the invention can be formed in one piece onto one or more support elements, so that they form an identification plate set whose identification plates can be inscribed in a setting device in the inscription device. It is practical if a base element of the support element is first produced from plastic, by means of an injection-molding or extrusion method. Subsequently, the surfaces of the base element of the base bodies are provided with the metallic coating.

It is advantageous if the identification plate has at least one engagement element that projects out of its rear side, which faces away from the front side. It is practical if this element comprises part of the base body and part of the coating. The engagement element is therefore produced predominantly from elastic plastic, on the one hand, and on the other has a coating that covers the surface of the plastic, made of heat-resistant metal. It is advantageous to use a material that contains chrome and/or aluminum as a component as the material for the coating.

A coating made of a ferromagnetic, particularly a permanently magnetic material, is also particularly advantageous. This can be a metal or an alloy, i.e. an intermetallic compound.

It is preferred that the coating has an essentially uniform thickness. The contours of the identification plate are then predetermined by the contours of the base body, and are hardly changed by application of the metallic coating.

The identification plates according to the invention can be produced individually or as an identification plate set. It is advantageous if the coating is applied by means of immersion of the base bodies and, if applicable, the base element into an immersion bath of a liquid metal or alloy. The surface of the plastic is melted as the result of the contact with the hot metal, so that the coating adheres better. However, it is also possible that the coating is applied by means of sputtering, varnishing, anodization, or powder coating.

Figure 1:
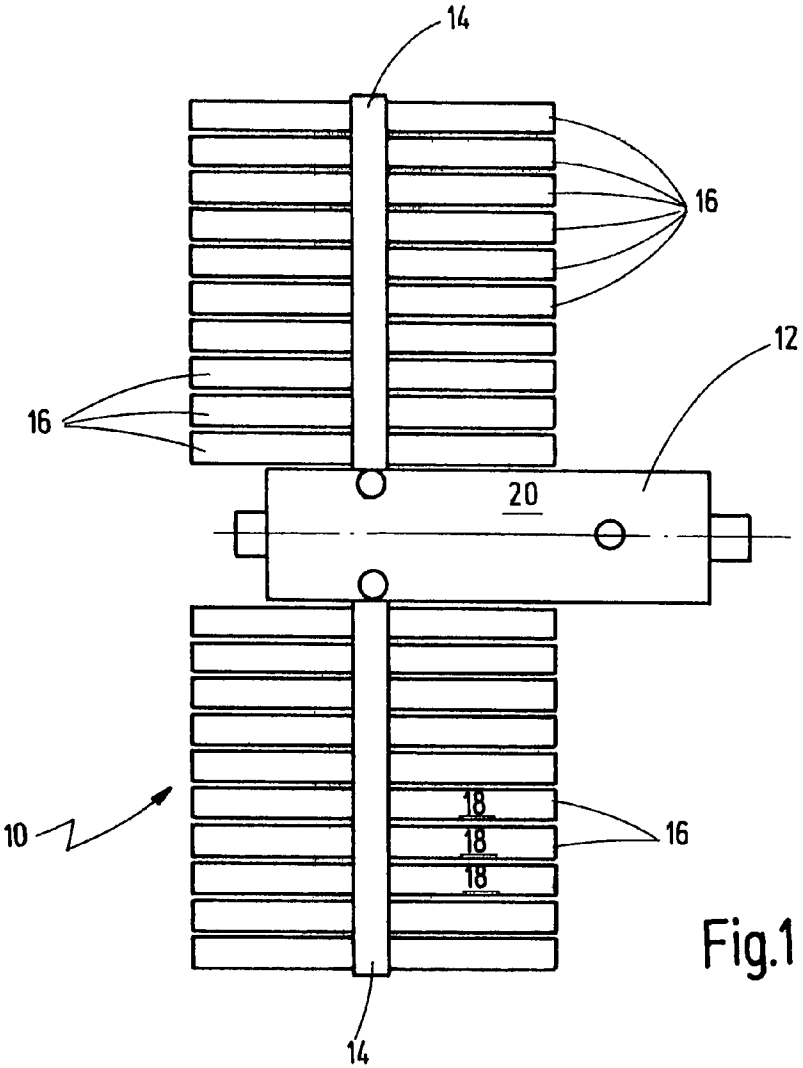

In the following, the invention will be explained in greater detail, using an exemplary embodiment shown schematically in the drawing. This shows:

FIG. 1 an identification plate set in a top view, and

FIG. 2 a section through an identification plate of the identification plate set according to FIG. 1.

An identification plate set 10 according to FIG. 1 has a central support 12 configured as an elongated panel, from which a support element 14 extends, in each instance, from the longitudinal sides that face away from one another. In this connection, the longitudinal axis of each of the support elements 14 runs perpendicular to the longitudinal axis of the central support 12. Identification plates 16 are formed onto the support elements 14, onto their longitudinal sides, which plates are connected with the support elements by means of a planned breakage point, in each instance. The identification plates 16 are disposed in one plane, so that they can be jointly inscribed in an inscription device. Their inscription surfaces 18, which are shown in a top view according to FIG. 1, lie in one plane with the inscription surface 20 of the central support 12. The arrangement of the identification plates 16 according to FIG. 1 corresponds to the first exemplary embodiment of DE-10 2005 058 387.

Each of the identification plates 16, as shown in FIG. 2, has a base body 22 made of plastic, whose entire surface is provided with a metallic coating 24 having a uniform thickness. On the rear side, which faces away from the inscription surface 18, the identification plate 16 has a projecting engagement element 26 that extends in the longitudinal direction of the plate and thickens slightly towards its free end. The engagement element 26 comprises part of the base body 22 made of plastic and part of the metallic coating 24.

In principle, the central support 12 and the support elements 14 have the same structure as the identification plate 16: They also have a base element made of plastic, which is provided with a metallic coating 24. Thus, the identification plate set 10 consists of a plastic core that carries a metallic coating that sheathes it completely.

It is, of course, understood that the arrangement of the identification plates 16 is not restricted to the exemplary embodiment shown in FIG. 1. Instead, the application is also supposed to cover identification plate sets whose identification plates are disposed as in the other exemplary embodiments of DE-10 2005 058 387. Furthermore, the application is supposed to cover identification plate sets whose identification plates are disposed as described in DE-37 25 217 C2.

In summary, the following should be stated: The invention relates to an identification plate 16 for identifying preferably electrical components, having a front side that has the inscription surface 18. According to the invention, the identification plate 16 has a base body 22 made of plastic and a metallic coating 24 that covers the surface of the base body 22.

The invention claimed is:

1. Identification plate set having a number of identification plates for identifying electrical components, and having at least one support element onto which the identification plates are formed, wherein the identification plates have a base body made of plastic and a front side that has the inscription surface, and wherein the at least one support element has a base element made of plastic, wherein the surfaces of the base bodies of the identification plates and of the base element at the at least one support element have a metallic coating that completely sheaths the base bodies and the at least one support element.

2. Identification plate set according to claim 1, wherein the identification plates each have at least one engagement element that projects out of the rear side that faces away from the front side.

3. Identification plate set according to claim 2, wherein the at least one engagement element comprises part of the base body and part of the coating.

4. Identification plate set according to claim 1, wherein the coating contains chrome and/or aluminum as a component.

5. Identification plate set according to claim 1, wherein the coating has a ferromagnetic material, preferably a permanently magnetic material.

6. Identification plate set according to claim 1, wherein the coating has a uniform thickness.

* * * * *